United States Patent [19]

Higashio et al.

[11] Patent Number: 5,060,921

[45] Date of Patent: Oct. 29, 1991

[54] IMAGE FORMING APPARATUS

[75] Inventors: Kimihiko Higashio; Masazumi Ito; Kadotaro Nishimori, all of Osaka, Japan

[73] Assignee: Minolta Camera Kabushiki Kaisha, Osaka, Japan

[21] Appl. No.: 482,536

[22] Filed: Feb. 21, 1990

[30] Foreign Application Priority Data

Feb. 22, 1989 [JP] Japan ..... 1-42594

[51] Int. Cl.[5] ..... B42B 1/02

[52] U.S. Cl. ..... 270/53; 355/324

[58] Field of Search ..... 270/37, 53, 58; 355/310, 321, 322, 323, 324

[56] References Cited

U.S. PATENT DOCUMENTS 3,709,595 1/1973 Turner et al. .
4,740,810 4/1988 Ito .
4,763,163 8/1988 Hamano et al. .
4,801,133 1/1989 Ishiguro ..... 270/53
4,811,048 3/1989 Ishikawa et al. .
4,852,867 8/1989 Johdai et al. .
4,864,350 9/1989 Ishiguro et al. .
4,878,656 11/1989 Honjo ..... 270/53
4,886,259 12/1989 Ishikawa et al. .
4,893,152 1/1990 Ishiguro et al. .
4,901,994 2/1990 Ishiguro et al. .
4,905,053 2/1990 Matsuo et al. .
4,905,055 2/1990 Higaki .
4,925,177 5/1990 Nakamura et al. .
4,946,152 8/1990 Ishikawa et al. .
4,958,820 9/1990 Johdai et al. .

*Primary Examiner*—Edward K. Look
*Assistant Examiner*—Therese M. Newholm
*Attorney, Agent, or Firm*—Burns, Doane, Swecker & Mathis

[57] ABSTRACT

An image forming apparatus which forms images on sheets fed selectively automatically or manually, and finishes copy sheets such as stapling them into booklets and/or stamping them under a control provided by an electronic control system. The control system prohibits simultaneous operations of finishing and feeding sheets manually.

10 Claims, 16 Drawing Sheets

IMAGE FORMING APPARATUS

BACKGROUND OF THE INVENTION

The present invention relates to an image forming apparatus for forming an image on a recording material, hereinafter referred to as sheet, supplied from a supplier.

There are occasions when copy sheets (i.e. sheets on which images are formed) from a copying machine are stapled into booklets, and a stapler for such use is known and used. To achieve the binding process a finisher is known and used. There are another occasions when a mark "Confidential" or "Circulate" is stamped on copy sheets, and a stamping device for such use is known and used. The stapler, stamping device and so on are generally called a finisher. The known finishers are designed to handle copy sheets having a predetermined size which are stacked in such a number as not to exceed the capacity of the finisher.

However, there are problems involved in operating the known finishers; for example:

(1) When the image forming apparatus is equipped with a manual sheet inserting section, it may happen that unsuitable sheets such as those out of size for the finishing process are supplied.

(2) There are occasions when the operation of the finisher must be prohibited for particular reasons. For example, when several copy sheets are separately needed, they must be obtained without the finishing process in order to avoid a jamming of sheets, an error on the finisher and wasting staples, etc.

There are another occasions when the manual sheet insertion mode must be prohibited during the finishing mode.

In these cases the associated operations of the copying operation on sheets from the manual sheet insertion section and the finishing process, particularly the stapling operation, must be prohibited.

SUMMARY OF THE INVENTION

Accordingly, an object of the present invention is to provide an image forming means for forming an image on sheets, the apparatus comprising a manual sheet insertion section and a finishing means and being capable of prohibiting the associated operations of copying on manually supplied sheets and finishing them, thereby avoiding the occurrence of sheet jamming, failure on the finisher, etc.

According to one aspect of the present invention there is provided an image forming means which comprises means for forming images on sheets; means for feeding the sheets to the image forming means, the sheet feeding means including a manual sheet insertion section from which an operator can manually feed optional sheets; means for effecting a finishing process on the copy sheets; and a control means for banning the associated operations of the manual sheet insertion section and the finishing means.

Preferably, the finishing means comprises a stapler which staples a stack of copy sheets into booklets.

According to another aspect of the present invention, there is provided an image forming means which comprises means for forming images on sheets; means for feeding the sheets to the image forming means, the sheet feeding means including an automatic sheet feeding section and a manual sheet insertion section from which an operator can manually feed optional sheets; means for effecting a finishing process on the copy sheets; a first means for selecting the use of the manual sheet insertion section; a second means for selecting the use of the finishing means; and a control means for banning the associated operations of the finishing means and the manual sheet insertion section.

The control means for banning the associated use of the finishing means and the manual sheet insertion section can be various as follows:

(1) The selection of the use of the manual sheet insertion section by the first selecting means is prohibited under condition that the use of the finishing means is selected.

(2) The selection of the use of the finishing means is released when the manual sheet insertion section is selected by the first selecting means under condition that the use of the finishing means is selected, thereby effecting the selection of the use of the manual sheet insertion section.

(3) The selection of the use of the finishing means by the second selecting means is prohibited under condition that the manual sheet insertion section is selected.

(4) The selection of the use of the manual sheet insertion section is released when the use of the finishing means is selected by the second selecting means while the manual sheet insertion section is selected, thereby effecting the selection of the use of the finishing means.

Other objects and advantages of the present invention will become more apparent from the following detailed description, when taken in conjunction with the accompanying drawings which show, for the purpose of illustration only, embodiments in accordance with the present invention.

DETAILED DESCRIPTION OF THE PREFERRED EMBODIMENTS

Figure 1:
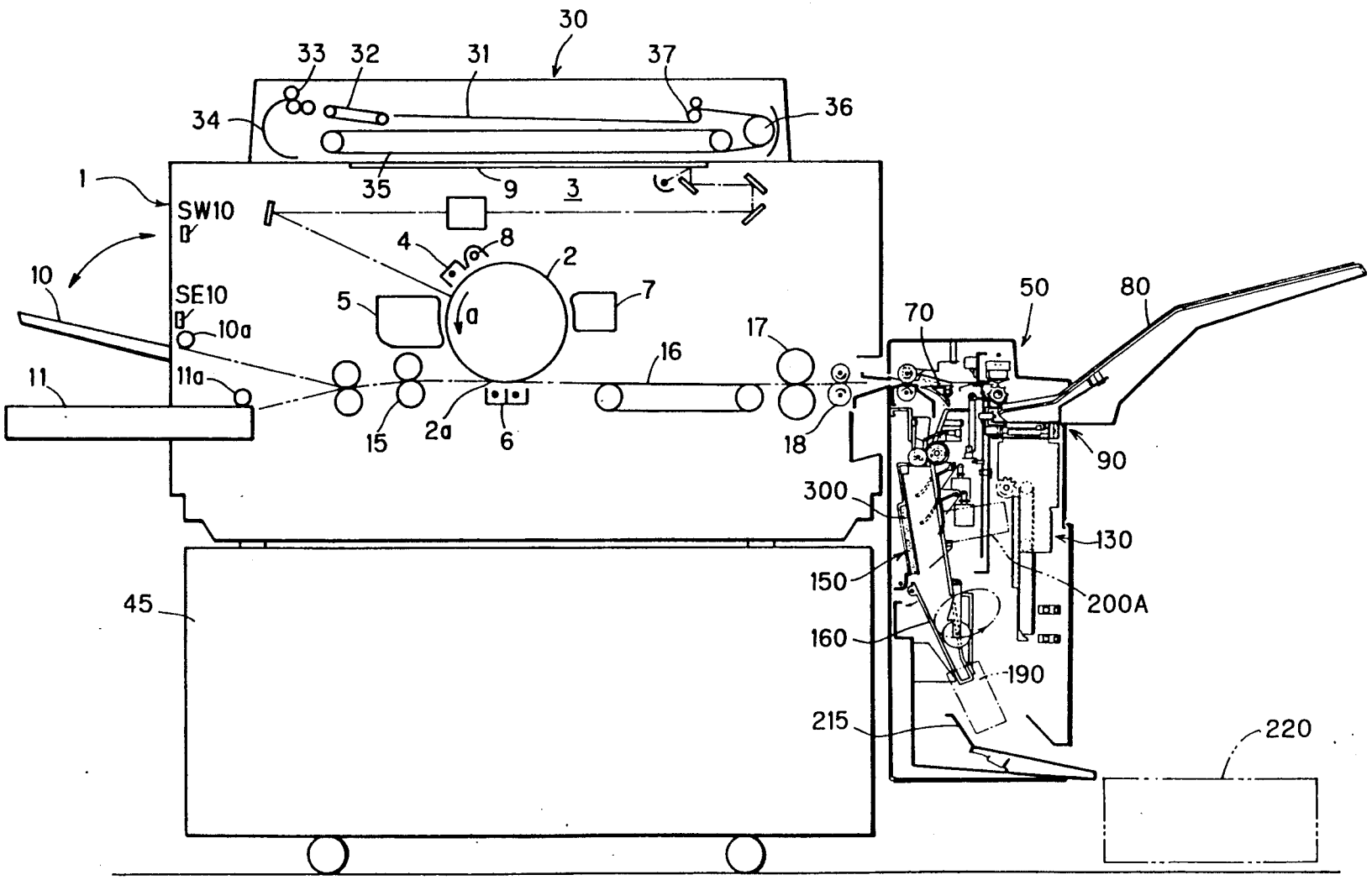
FIG. 1 is a schematic view showing a copying machine including a finisher unit according to the present invention.

FIG. 1 illustrates a copying machine as a typical example of the image-forming apparatus. The copying machine includes a detachable finisher unit 50.

COPYING MACHINE

The copying machine has a main body 1 which stands on a desk 45 and has a recirculating document handler 30 (hereinafter called the RDH). The main body 1 houses a photosensitive drum 2 (hereinafter called the drum) capable of rotating in a direction of arrow (a). Disposed around the drum 20 are image forming elements such as an optical system 3, a charger 4, a developing unit 5, a transfer charger 6, a cleaning device 7, and an eraser lamp 8. Since the operations of these elements and the copying process thereunder are well known, the explanation will be omitted for simplicity.

An automatic cassette 11 stores sheets fed by a feeder roller 11*a* one by one. Timing rollers 15 feed the sheets to a transfer section 2*a* synchronously with a toner image formed on the drum 20. A conveyor belt 16 feeds the sheet having the transferred toner image from the drum 20 to fixing rollers 17 which fix the toner image on the sheet. Discharging roller 18 discharge the copy sheet.

Figure 2:
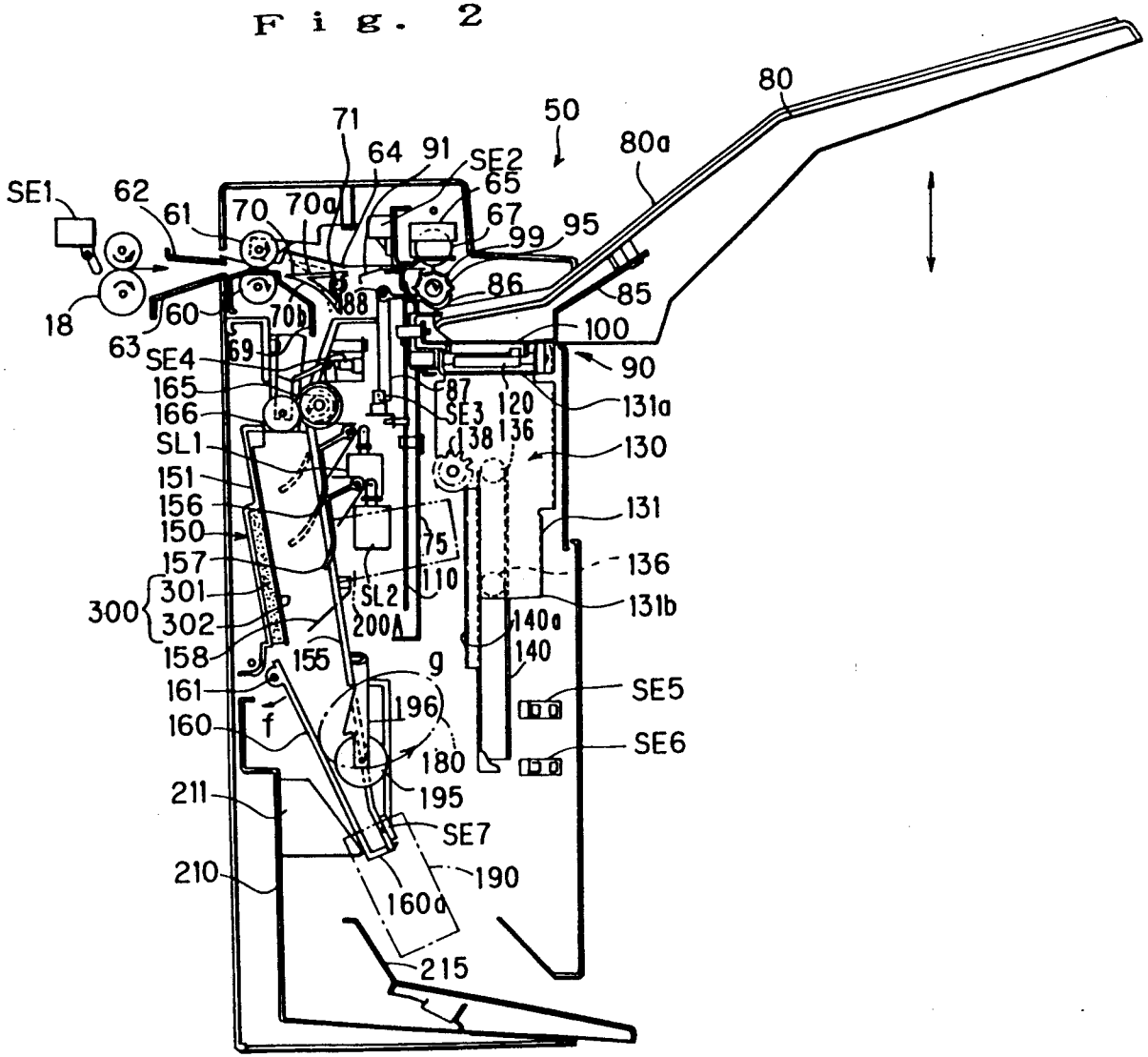
FIG. 2 is a schematic cross-section through the finisher unit of FIG. 1.

As shown in FIG. 2 a sensor SE1 is disposed immediately before the discharging rollers 18 which detects the copy sheet.

The reference numeral 10 denotes a manual sheet insertion tray, which is hinged to the main body 1 of the copying machine. When it is not in use, the tray 10 is folded to come into abutment with a switch SW10, and when it is used, the tray 10 is unfolded. A feed roller 10*a* feeds sheets inserted by hand, and a sensor SE10 detects them.

The RDH 30 includes a tray 31 for placing an original, a sheet feed belt 32, a pair of sheet feeder rollers 33, a turn-over guide plate 34, a conveyor 35 a turn-over roller 36, a pair of discharging rollers 37. The RDH 30 circulates originals consecutively from the last page to the first. The originals are placed on the tray 31 with the first page on top and the last page at the bottom. The last page is pulled out by the belt 32, and fed along the plate 34 into between the conveyor belt 35 and a glass panel 9, and is placed at a predetermined position on the glass panel 9 by the belt 35. Then, the original is exposed to light by the optical system 3. After it is exposed to light, the original is fed from the glass panel 9 to the right in FIG. 1, and fed by the pair of discharging rollers 37 through the turn-over roller 36 so as to be placed face up on the first page on the tray 31. In this way the originals are consecutively fed. The belt 32, and the conveyor 35 are driven by a motor (not shown).

The numbers of originals and of sheets are input by a ten-key on each of operation panels of the RDH and the main body 1. Every time when a number of originals on the tray have been copied, the copying operation is temporarily stopped, and a discharging tray 80 is shifted as described hereinafter or a stapling and/or stmping operations are executed. Instead of using the RDH 30, it is possible that the RDH is raised and an original is placed direct on a glass panel.

FINISHER UNIT

The finisher unit 50 accommodates the copy sheets discharged from the main body 1 on the discharging tray 80 or accommodate them on a stapling tray 150 on which they are aligned and stacked, and stapled into a booklet. Instead of stapling or at the same time as stapling, a desired mark can be stamped on the copy sheet. In stapling and/or stamping, the copy sheets are placed one by one onto the stapling tray 150. When a desired number of originals have been circulated, and a copy end signal is sent, and after the last page is aligned on the tray 150, the stapler 190 alone or a stapler 190 and the stamping unit 200A are operated so as to bind the copy sheets into a booklet by the stapler 190 and/or stamp a desired mark or letter on the booklet by the stamp 200A. Booklets are put in a bucket or basket 220.

The finisher unit 50 includes sheet receiving rollers 60, 61, a change-over guide 70, a tray 80, a shifting block 90 for shifting the tray 80 perpendicularly to the sheet discharging direction every time when a number of copy sheets corresponding to that of originals are stacked in the tray 80, an elevating block 130 for intermittently lowering the tray 80 so that the height of copy sheet stacks on the tray 80 is virtually made constant, a stapling tray 150 having a stapler and a stamp, and a guide plate 215 for allowing a finished booklet to drop into the bucket 220 by gravity.

A copy sheet receiving section includes a driving roller 60, a follower roller 61, and a pair of guides 62, 63 corresponding to the pair of discharging rollers 18. The finisher 50 also includes the change-over guide 70, guides 64, 69 and 91, and a sensor SE2 for detecting copy sheets discharged into the tray 80.

The change-over guide 70, shaped like a beak, is rotatable around a pivot 71.

The change-over guide 70 is operated by turning on a solenoid SLX (FIG. 7) connected to an arm (not shown) joined to the pivot 71, and moves from the position indicated by full line in FIG. 2 to a position indicated by dotted lines in FIG. 2 against a spring (not shown) acting on the arm. When the change-over guide 70 is at the position indicated by full line, its top surface 70*a* guides the copy sheets toward the tray 80, and when it is shifted to the position indicated by dotted lines, its curved surface 70*b* guides the copy sheets toward the stapling tray 150.

The copy sheets are discharged into the tray 80 by discharging rollers 95 driven by a motor MX (omitted in FIG. 2 but refer to FIG. 7) and balls 67 with which they come into contact by gravity. After being discharged, the copy sheets are aligned by a rotary paddle 99 coaxial with the discharging roller 95. The rotary paddle 99 has a plurality of radial blades. In FIG. 2, when the paddle 99 rotates in a clockwise direction, it pushes the copy sheets at their rearward ends in an opposite direction to the discharging direction until they come into abutment with a fixed plate 75. In this way the copy sheets are aligned at their one sides.

The finisher unit 50 sorts the copy sheets by a timely shift of the tray 80. The discharging rollers 95 and the rotary paddle 99 are mounted so that they can be withdrawn so as not to disturb the aligned copy sheets in association with the shifting of the tray.

As shown in FIG. 2, the tray 80 is provided with a plurality of ridges 80*a* on the surface, the ridges extending in a direction in which the copy sheets are discharged. A shift frame 100, which constitutes a shift block, supports the tray 80 by means of a bracket 85. The rearward end of the tray 80 extends to a point adjacent to an upper portion of the fixed plate 75. Disposed above the rearward end of the tray 80 is an actuator 86 of a sensor SE3. The actuator 86 is connected to a lever 87, and they are rotatable around a pivot 88, wherein the lowest end of the lever 87 normally blocks an optical axis of the sensor SE3. The copy sheets are gradually stacked on the tray 80, and finally come into abutment with the actuator 86 which is raised. As a result, the lever 87 rotates around the pivot 88 in a counterclockwise direction in FIG. 2, thereby moving away from the optical axis of the sensor SE3. Thus the top level of the copy sheets is detected, and in response to the detection, the elevator block 130 is operated to cause the tray 80 to descend. The elevator block 130 carries the shift block 90 and causes the tray 80 to ascend or descend.

Figure 3:
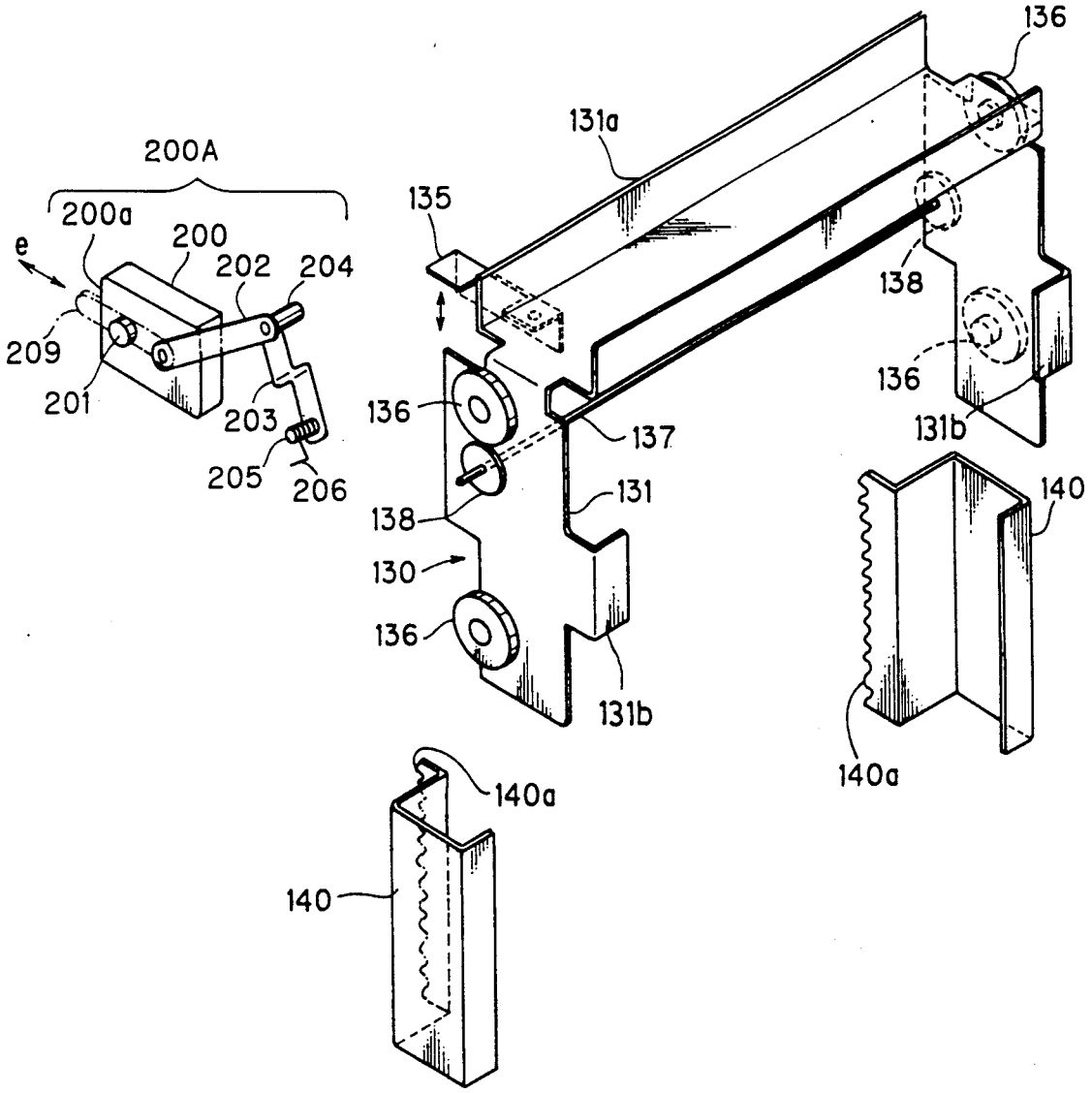
FIG. 3 is an exploded perspective view of an elevator block and a stamping unit.
Figure 7:
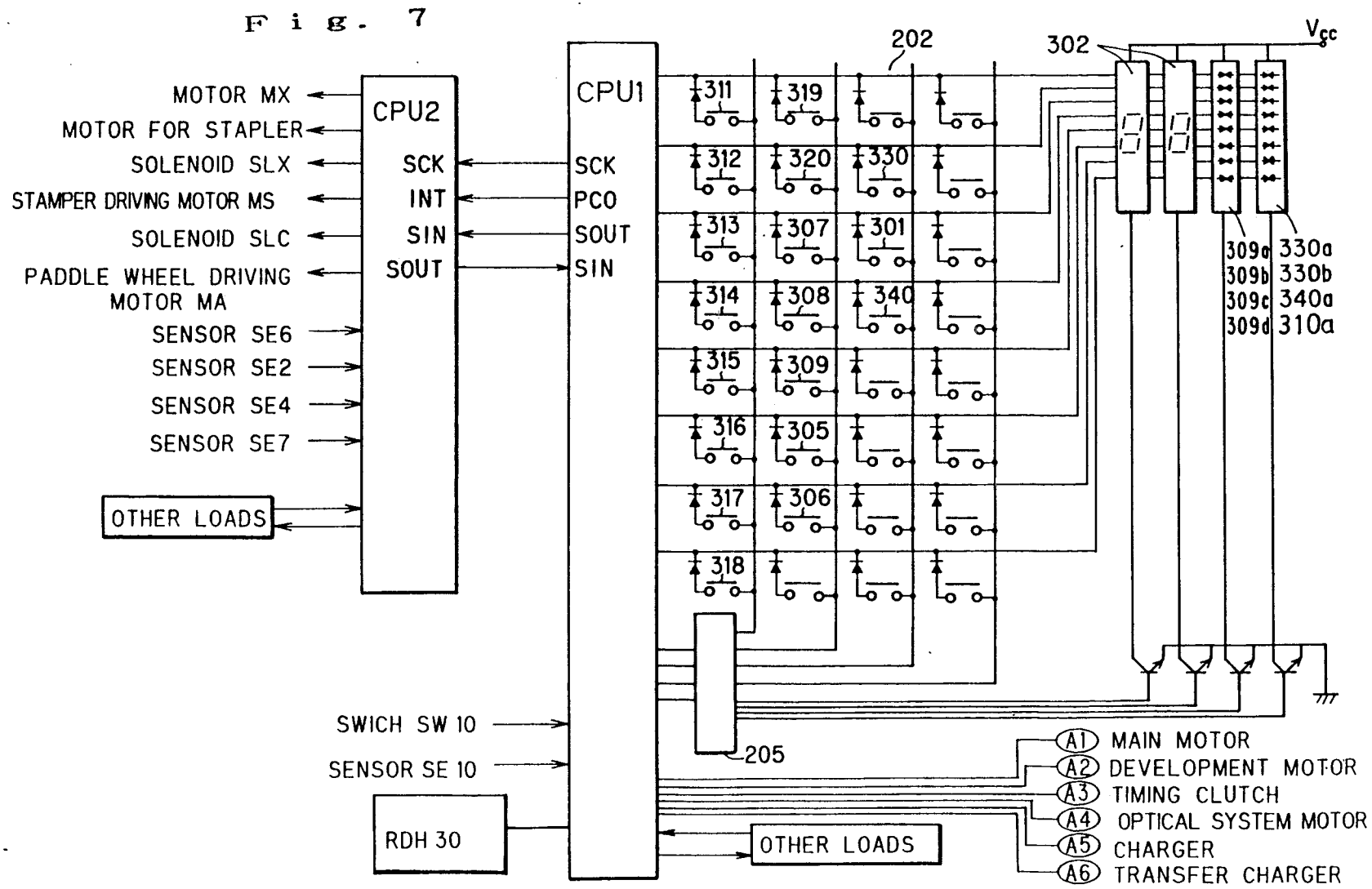
FIG. 7 is a control circuitry for the copying machine.

Referring to FIG. 3, a shifter 131 will be described, which supports the shift frame 100 and enables it to ascend and descend. The shifter 131 includes rollers 136 provided on opposite sides thereof. The rollers 136 rotate in contact with the inside wall of guide frames 140 which are fixed to a main frame (not shown). The shift frame 131 includes pinions 138 fixed to a shaft 137 on the frame 131. The pinions 138 are in mesh with racks 140*a* formed in the guide frames 140, and are rotated by a reversible motor MS (FIG. 7). In accordance with the rotation of the pinions 138, the shifter 131 descends and ascends together with the shift frame 100 and the tray 80.

Sensors SE5 and SE6 are disposed below the elevator block 130. These sensors are operated when their optical axes are blocked by protrusions 131*b* of the shift frame 131. When the sensor SE5 is operated, it indicates that the tray 80 is filled up with the copy sheets, which is signalled to the main body 1 of the copying machine. Where necessary, some copy sheets must be removed. The shift frame 131 descends until its protrusion 131*b* is detected by the sensor SE6.

STAMPING FUNCTION

Figure 4:
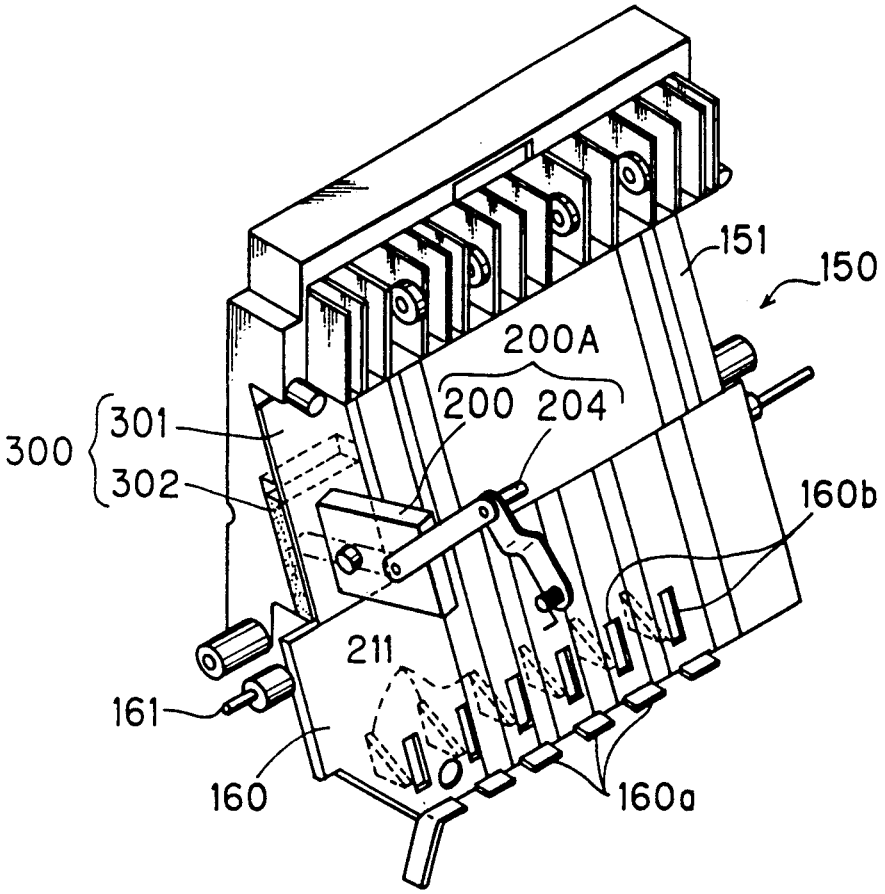
FIG. 4 is a perspective view showing a portion of a stapling tray and the stamping unit.

Referring to FIGS. 3 and 4, a stamping unit 200A stamps marks "Confidential", "Circulate", etc. on copy sheets stacked in a staple tray 150. The stamping unit 200A is provided in opposition to a stamp receiving plate 300 located toward the side of a base plate 151 of the stapling tray 150, the side making a reference by which the copy sheets are aligned. The stamping unit 200A is driven by the shifter 131. The stamping unit 200A includes a stamp block 200 having a stamp 200*a* which faces in the direction of arrow (e) and having a pin 201 freely fitting in a guide slot 209 of a structure (not shown) so as to be movable in the direction of arrow (e). A link 202 is rotatably connected to the stamp block 200 and a link 203 is rotatably connected to the link 202 by means of pins 204. The link 203 is rotatably connected to the structure by a pin 205, and is normally biased upward by a coil spring 206.

The shifter 131 supporting the shift frame 100 has a horizontal portion 131*a* including a bracket 135 which pushes down the pin 204 so as to enable the stamp block 200 to move in the direction of arrow (e). In this way a desired mark is stamped on the copy sheet stored in the stapling tray 150. The stamping is practised immediately after the stapler 190 staples the copy sheets into a booklet under a stapling mode and a stamping mode. Simultaneously with the completion of the stamping operation the sensor SE6 is operated to rotate the motor MS reversely. In this way the shifter 131 ascends and returns to its original position. The links 202 and 203 are released from the pressure provided by the brackets 135. The stamp 200*a* returns to its original position under the action of the spring 206.

The stamping unit 200A is not limited to the structure described above. For example, it can be operated by a solenoid. A variety of modifications are of course possible.

STAPLING TRAY

As shown in FIGS. 2 and 4, the stapling tray 150, slightly slanted, includes the base plate 151, the guide plate 155 and a movable plate 160. The base plate 151 is provided with the stamp receiving plate 300 at one side, the stamp receiving plate 300 being located in opposition to the stamp block 200.

The stamp receiving plate 300 comprises soft elastic material having a low coefficient of friction $\mu$ so as to smoothly receive, align and discharge the copy sheets. The surface of the plate 300 is smooth and substantially as high as the surface of the tray.

More specifically, the illustrated stamp receiving plate 300 comprises a soft sponge 301 covered with a polyester film 302. The material of the plate 300 is not limited to the filmed sponge but silicone rubber, rubber covered with polyester film, or a elastic material coated with a paint having low coefficient of friction can be selectively used. In short, any material will do if it produces a clear-cut mark on the copy sheets irrespective of any decline of the stamping unit 200A, curls of copy sheets and an increased thickness of a stack of copy sheets.

In general, a paper-to-paper coefficient of friction is in the range of about 0.3 to about 0.7, normally about 0.4. Accordingly, a coefficient of friction $\mu$ between the surface of the stamp receiving plate 300 and the copy sheet is adjusted not to exceed 0.4, more preferably 0.3 or less. The illustrated embodiment has a frictional factor $\mu$ of about 0.2 to 0.3.

The movable plate 160, intended to restrain the lower ends of copy sheets, is rotatably supported by a shaft 161 and connected to a solenoid SLC (FIG. 7). When the solenoid SLC is off, the movable plate 160 engages a lower part of a guide plate 155 to close the bottom of the stapling tray 150. When the solenoid SLC is on, the movable plate 160 rotates in the direction of arrow (f) around the shaft 161 to release the bottom of the stapling tray 150 from closure.

Figure 5:
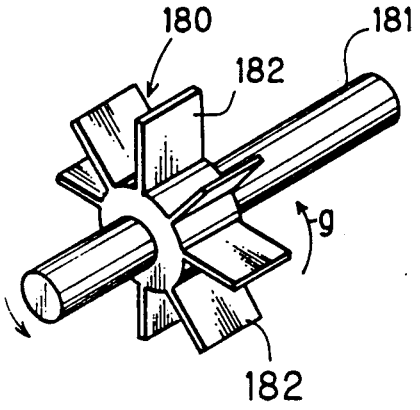
FIG. 5 is a perspective view showing a paddle wheel in the stapling tray.
Figure 6A:
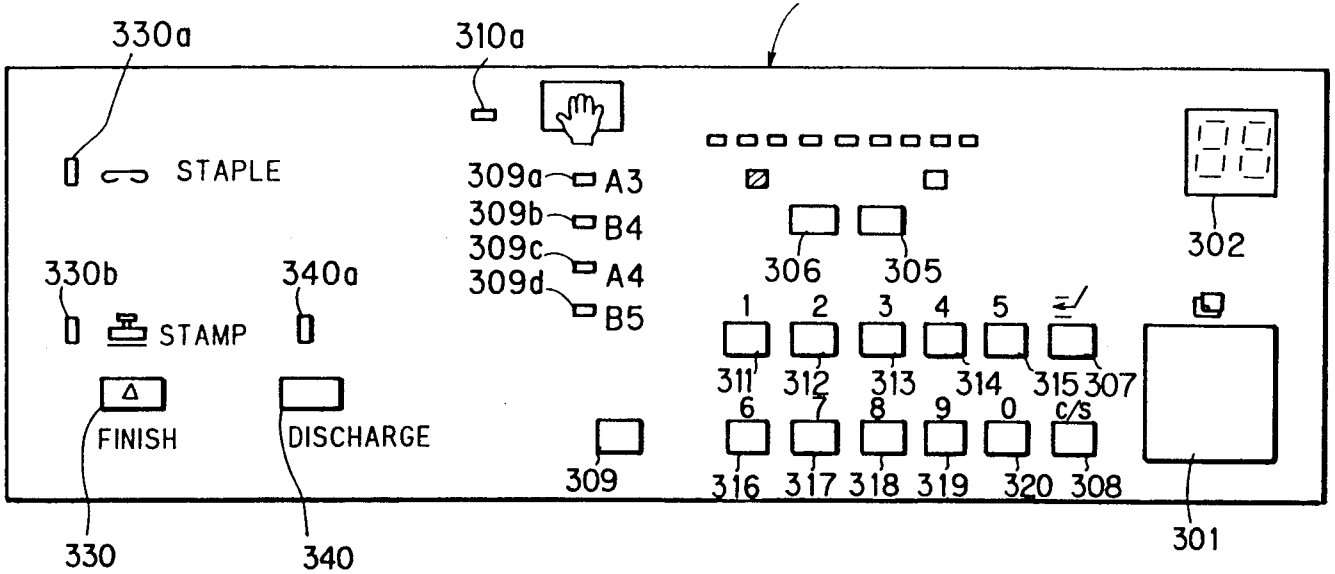
FIG. 6*a* is a plan view showing a operation panel on the main body of the copying machine.
Figure 6B:
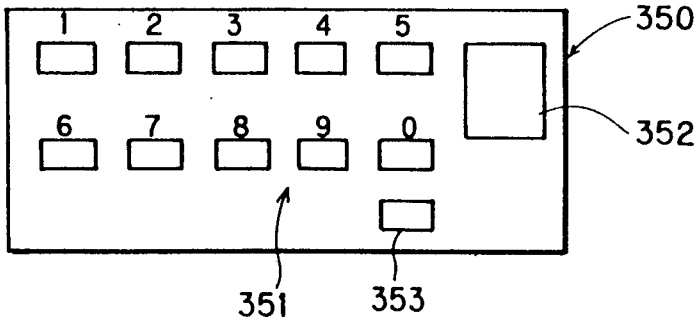
FIG. 6*b* is a plan view showing an operation panel on the RDH.

Disposed at the lower portion of the stapling tray 150 are a paddle wheel 180 and a stapler 190 for stapling a stack of copy sheets into a booklet, a guide roller 195, and a sensor SE7 for detecting the presence of copy sheets. As shown in FIG. 5, the paddle wheel 180 is provided with flexible vanes 182 radial of a shaft 181, the paddle wheel 180 being rotated in the direction of arrow (g) by means of a motor MA (FIG. 7). The vanes 182 rotate in contact with the copy sheets and cause them to drop one by one toward lower shelves 160*a* and also bring them into abutment with side plates (not shown) so as to align them at one sides.

The stapler 190, indicated in imaginary lines in FIGS. 1 and 2, is a known electric type. The illustrated staple 190 is manufactured by Max Inc. which is equipped with an electric motor. It has a bench for receiving the staples, the bench being maintained flush with the movable plate 160. The copy sheets are stapled at their corners. The stapler 190 is not limited to the illustrated one but other types can be used.

The guide roller 195 is rotatably provided at a lower end of a lever 196 joined to the guide plate 155. The guide roller 195 prevents their stapled portions from increasing in volume. The upper end of the guide plate 155 extends toward a point adjacent to the change-over guide 70 and guides the copy sheets up to the stapling tray 150 in cooperation with another guide plate 69. Disposed above the stapling tray 150 feed rollers 165 and 166 for feeding the copy sheets into the stapling tray 150, and a sensor SE4 for detecting the presence of the copy sheets.

The guide plate 155 is provided with regulator levers 156 and 157, and a brush 158 for discharging the copy sheets. The regulator levers 156 and 157 advance into the stapling tray 150, and moves up to a point indicated in dotted lines in FIG. 2. They prevent the copy sheets from becoming disordered owing to falling down. They are positioned at such a place as to be in agreement with the size of the copy sheets ready to be stapled, and to regulate the upper ends of the copy sheets.

The stapled copy sheets are discharged from the stapling tray in the following manner:

Referring to FIGS. 2 and 4, the finisher unit 50 has a frame 210 which includes projecting members 211 in opposition to the lower ends of the copy sheets placed in the stapling tray 150. The movable plate 160 has slots **160*b* corresponding to the respective projecting members 211. After copy sheets are stapled into a booklet, the movable plate 160 rotates in the direction of arrow (f) so as to open the bottom of the stapling tray 150, and enable the projecting members 211 to project through the slots 160*b*. In this way the projecting members 211 push the lower ends of the copy sheets which would otherwise be blocked from discharging from the stapling tray because of moving in the direction of (f) while their lower ends are engaged with the lower shelves 160*a* of the movable plate 160. The projecting members 211** have slant edges adapted to discharge the copy sheets smoothly.

A guide plate 215 guides the finished booklets and lead them into a bucket or basket 220 (FIG. 1).

OPERATION PANEL AND CONTROL CIRCUIT

Next, an operation panel 300 of the copying machine will be described:

The operation panel 300 includes the following operation keys and display light emitting diodes (LED):

301: a key for starting the copying operation;

302: a 7-segment display for indicating the number of copy sheets and the symbol characters denoting the status of the copying machine.

305/306: an up and down key for setting the density of image.

307: an interruption key.

308: a clear-stop key for releasing the registered number and stopping the copying operation.

309: a selection key for selecting a size of a sheet for copying.

**309*a* to 309*d***: a display for indicating a selected sheet size.

**310*a***: a display for indicating the manual sheet insertion mode.

311 to 320: ten-keys for setting the number of sheets for copying.

330: a selection key for selecting the finish mode (non-stapling mode, stapling mode, stapling-and-stamping mode).

**330*a***: a display for indicating the stapling mode.

**330*b***: a display for indicating the stamping mode.

340: a discharge key for discharging copy sheets from the stapling tray.

**340*a***: a display for indicating the discharge of copy sheets being in progress.

Referring to FIG. **6*b*, an operation panel 350 of the RDH 30** will be described:

The operation panel 350 includes a ten-key 351 for inputting the number of originals, a display 352 for indicating the input number of originals, and a cancellation key 353 for cancelling the display. The number of originals is input by the ten-key 351 only when they are placed on the tray 31 of the RDH 30. A sensor (not shown) detects the presence of originals on the tray 31.

Referring to FIG. 7, a control system for controlling the main body 1 of the copying machine and the finisher unit 50 will be described:

The control system includes a micro-computer CPU1 (hereinafter referred to as the CPU1) for the main body 1 and a micro-computer CPU2 (hereinafter referred to as the CPU2) for the finisher unit 50. The CPU1 and CPU2 each includes a random-access-memory (RAM) and a read-only memory (ROM), and the CPU2 is connected to the CPU1.

A switch matrix 202 including the key switches 301, 302, 305 to 309, 311 to 320, 330, and 340 on the operation panel 300, a switch SW10 for indicating the inoperative state of a manual sheet insertion tray 10 and a sensor SE10 are connected to an input port of the CPU1. The 7-segment display 302 is connected thereto through the matrix 202 and a decoder 205. An on/off signal is transmitted from an output port of the CPU1 to image forming elements such as a main electric motor within the main body 1, a motor for driving the developing unit.

The RDH 30 is connected to the CPU1 so that it operates in response to instructions of the CPU1.

A sensor SE7 for detecting the presence of copy sheets in the stapling tray 150, a sensor SE4 for detecting the copy sheets in transit toward the stapling tray 150, a sensor SE2 for detecting sheets in transit toward the discharging tray 80, and a sensor SE6 for detecting a lower limit for the descent of the protrusion **131*b* of the shifter 130 are connected to an input port of the CPU2. From the output port thereof on/off signals are transmitted to a motor MX for discharging the copy sheets onto the tray 80, a motor for the stapler 190, a solenoid SLX for driving the change-over guide 70 to lead the copy sheets from the main body of the copying machine either to the stapling tray 150 or to the discharging tray 80, a motor MS for driving the stamping unit 200A, a solenoid SLC for opening the bottom 160 of the stapling tray 150, and a motor MA for driving the paddle wheel 180**.

The CPU1 and CPU2 are interconnected in the following manner:

A clock terminal SCK for the data sample of CPU1 and the output therefor, an interruption output terminal PCO, a data output terminal SOUT and a data input terminal SIN of the CPU1 are respectively connected to a clock input terminal SCK of CPU2, an interruption output terminal INT, a data input terminal SIN and the data output terminal SOUT of the CPU2.

The operation of the main body 1 of the copying machine is started by putting the key 301 on the operation panel 300, except for the manual sheet insertion copying. The subsequent steps advance in the aforementioned manner. The size of sheets is previously selected by the key 309, and the number of originals are set by the ten-key 351 on the operation panel 350 (when RDH is in use). The number of sheets to be copied is previously set by the keys 311 to 320 on the operation panel 300.

In the case of manual sheet insertion the sensor SE10 at the insertion port is made to turn on, and the procedure follows in the same manner as when the key 301 is turned on.

OPERATION MODE OF FINISHER UNIT

The finisher unit 50 is operable in the non-stapling mode, the stapling mode, and the stapling-and-stamping mode. These modes are selected by the selection key (rotation key) 330 on the operation panel 300. The lighting-up of the LED 330*a* indicates that the stapling mode is on. The lighting-up of the LED 330*b* indicates that the stamping mode is on. In the illustrated embodiment the LED 330*b* lights up only when the LED 330*a* is on. This means that the stamping mode can be selected only when the stapling mode is selected. When the LEDs 330*a* and 330*b* are off, the non-stapling mode is selected.

The non-stapling mode is a mode in which copy sheets from the main body 1 are stacked on the discharging tray 80. At this stage the change-over guide 70 is maintained in the position indicated in full line in FIG. 2, and the copy sheets are discharged onto the discharging tray 80 from between the discharging roller 95 driven by the motor MX and the balls 67. The copy sheets are aligned by the paddle 99. Every time when the sensor SE3 detects the presence of the copy sheets, the elevator block 130 is operated in the afore-mentioned manner, thereby making a distance from the nipping portions of the discharging roller 95 and the balls 67 from the top surface of the stacked copy sheets a previously fixed distance.

The discharging tray 80 is automatically shifted by the shift block 90 when the number of copy sheets is set to "2 or more" or when RDH 30 is in use with the number of stacks of copy sheets being set to "2 or more". More specifically, when a previous stack of copy sheets (plural copy sheets with the same images as one original or one set of copy sheets corresponding to a set of originals) is placed and the sensor SE2 detects the discharge of the last sheet, the discharging tray 80 is shifted to the right or left. In this way a desired number of stacks are finished.

The stapling mode is a mode in which the copy sheets from the main body 1 are stacked on the stapling tray 150, aligned by the paddle wheel 180, and stapled into a booklet which is stored in the basket 220. The change-over guide 70 is set to the position indicated in dotted lines in FIG. 2 by energizing the solenoid SLX. The copy sheets are fed into the stapling tray 150 through the feed rollers 165 and 166, and aligned by the paddle wheel 180. In this mode, when the RDH 30 is in use, the stapler 190 is automatically operated after a predetermined set of copy sheets are aligned, and when RDH is not in use, the stapler 190 is operated by pressing the key 340 on the operation panel. After the stapling is completed, the movable plate 160 is opened by energizing the solenoid SLC (FIG. 7), thereby allowing the stapled copy sheets to drop.

The stamping mode is a mode in which the stamping unit 200A produces marks on the top page of the desired number of copy sheets on the stapling tray 150. This mode is performed together with the stapling mode. Subject to the discharge key 340 being on, the stamping operation is carried out immediately after the copy sheets are stapled into a booklet. To effect the stamping operation, the motor MS (FIG. 7) operates the elevator block 130 so as to lower the shifter 131 together with the discharging tray 80 until the bracket 135 of the shifter pushes down the pin 204 and the sensor SE6 detects the protrusion 131*b* of the shift 131. The stamp block 200 is moved toward the copy sheet under the action of the links 202 and 203. The receiving plate 300 backs up the copy sheets so as to ensure a clear-cut mark. After the stamping operation is finished, the movable plate 160 is opened.

In the stapling mode or the stapling-and-stamping mode of the illustrated embodiment, the solenoid SLX is turned off in spite of the stapling mode being on, if the copy sheets in the stapling tray 150 reaches the maximum capacity of the tray 150. As a result, the change-over guide 70 is returned to the position indicated by full line in FIG. 2, and the following copy sheets are directed toward the discharging tray 80. At this state the copying operation continues until a number of sheets corresponding to that of originals are copied. If at this state the key 340 is pressed, the movable plate 160 is opened with the stapler 190 and the stamping unit 200A being out of operation, thereby discharging the copy sheets. At a later stage the discharged copy sheets and the copy sheets on the discharging tray 80 may be compiled and stapled into a booklet. If required, a desired mark is stamped.

Figure 8:
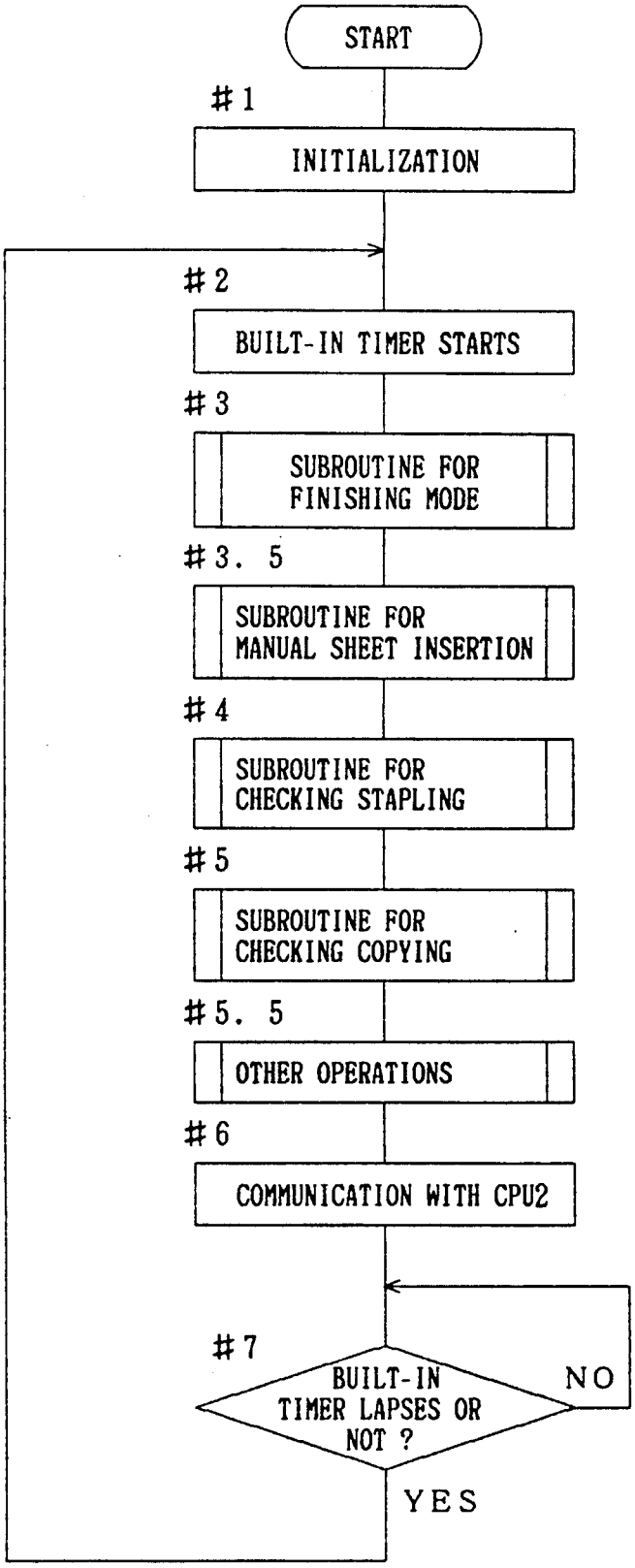
FIG. 8 is a flowchart showing a main routine executed by a micro-computer CPU1.

Referring to FIGS. 8 and 9, the operation of the to #6 subroutines are consecutively called into action. After all the subroutines are finished, the routine is finished upon the completion of the operation of the built-in timer, and the sequence returns to step #2.

Step #3 indicates a selection routine for the finish mode, step #3.5 indicates a routine for handling the manual tray, step #4 indicates a routine for judging the stapling operation, step #5 indicates a routine for the copying operation, step #5.5 indicates a routine for other operations, and step #6 indicates a routine for communication with the CPU2.

Figure 9A:
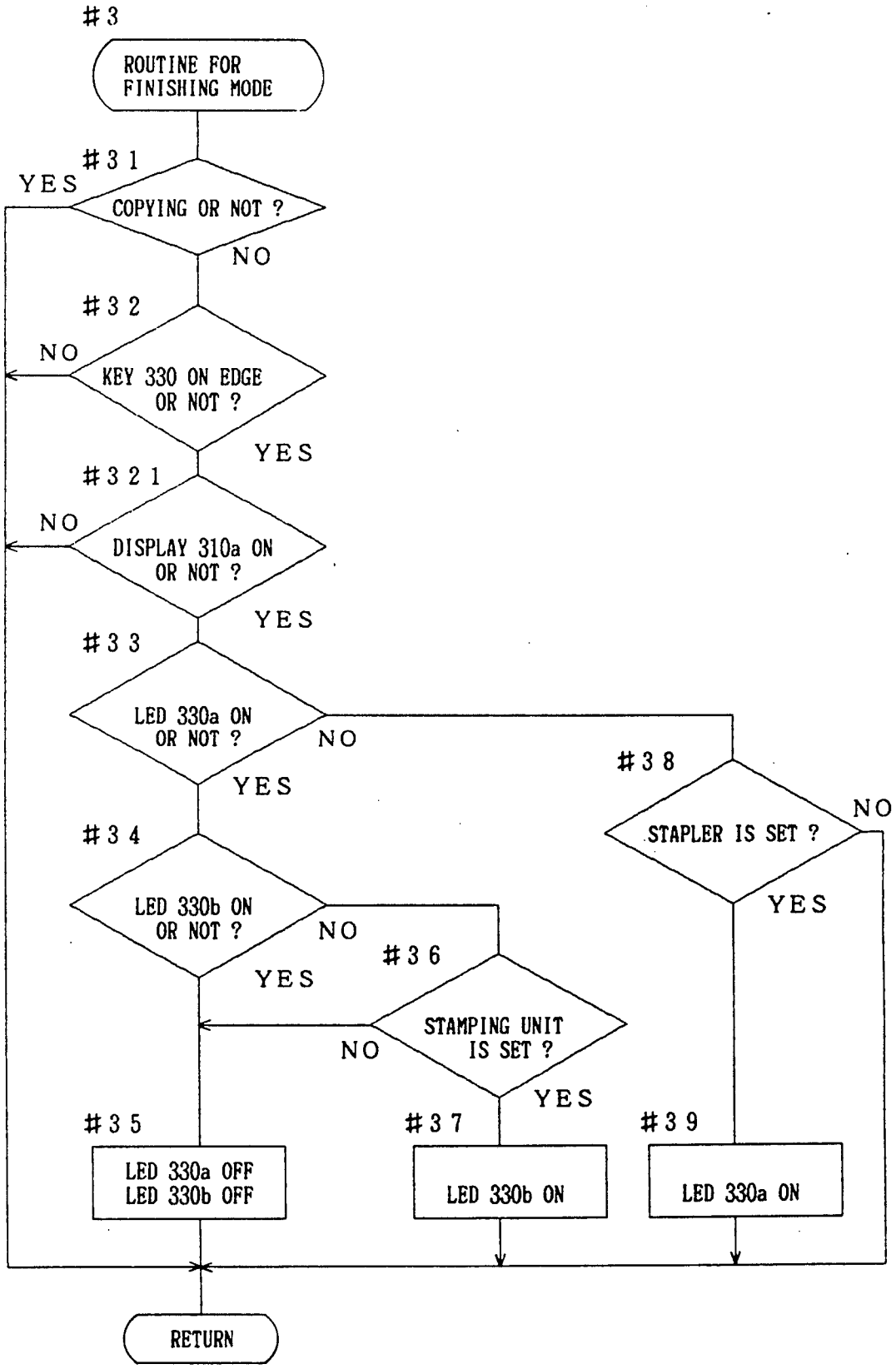
FIG 9*a* is a flowchart showing a routine for selecting a finishing mode.

Referring to FIG. 9*a*, the selection routine for the finish mode will be described:

Step #31 checks if the copying operation is in progress. When the operation is in progress, the sequence returns to the main routine, but when it is not in progress, step #32 checks if the selection key 330 for the finish mode has been just turned on (hereinafter referred to as "on edge"). If it is found to be not on edge, the sequence returns to the main routine. When it is on edge, step #321 checks if the display LED 310*a* for the manual operation is off or not. If the display LED 310*a* is found to be not off, the sequence returns to the main routine, but when it is off, step #33 checks if the display LED 330*a* is on or not. If it is found to be on, step #34 checks if the display LED 330*b* is on or not. If it is found to be on, step #35 turns off LED 330*a* and 330*b*. At Step #34 if LED 330*b* is not on, step #36 checks if the stamp is set or not. If it finds the stamping unit not set, the sequence advances to step #35. If it finds the stamping unit set, step #37 turns on LED 330*b*. If Step #33 finds that LED 330*a* is not on, the sequence advances to step #38 which checks if the stapler is set or not. When it is not set, the sequence returns to the main routine, and when it is set, step #39 turns on the LED 330*a*.

When step #37 turns on LED 330*b*, LED 330*a* is already on at step #33. In this way LED 330*b* is turned on on condition that LED 330*a* is on. This means that the stamping mode cannot be turned on without turning on the stapling mode.

At step #38, if the stapler is not set, LED 330*a* cannot be turned on even if the key 330 is pressed. Likewise, at step #36, if the stamping unit is not set, the LED 330*b* cannot be turned on even if the key 330 is pressed. The only possible thing is that LED 330*a* is turned off. This means that if the main body 1 is not equipped with the finisher unit it is impossible to select the stapling mode or the stamping mode even if the key 330 is pressed. If the main body 1 is equipped with the finisher unit but the finisher unit is not equipped with the stamping unit it is impossible to select the stamping mode. In this case, it is only possible to select the stapling mode and the non-stapling mode by operating the key 330.

Figure 9B:
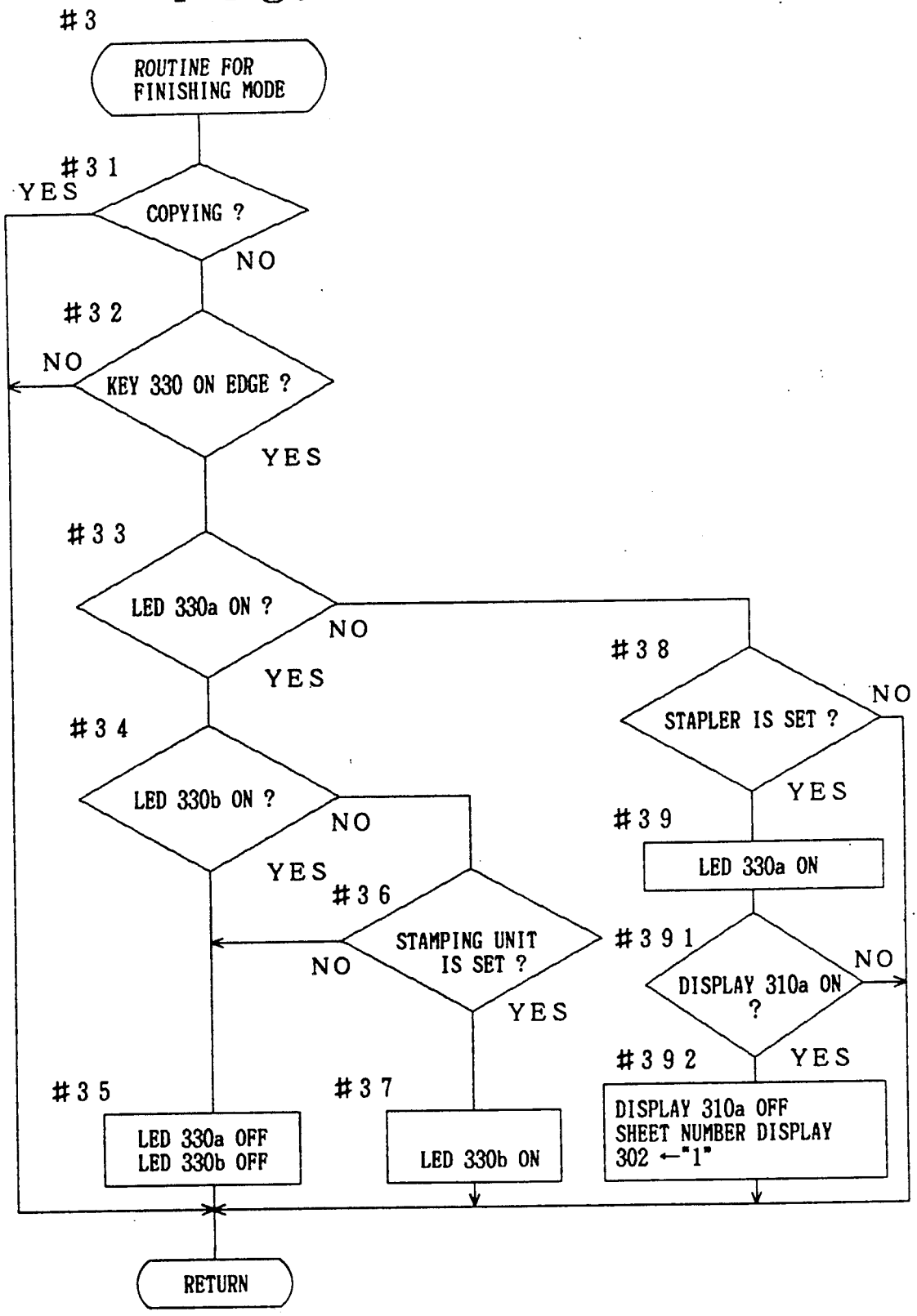
FIG. 9*b* is a flowchart showing a modified routine for selecting a finishing mode.
Figure 9C:
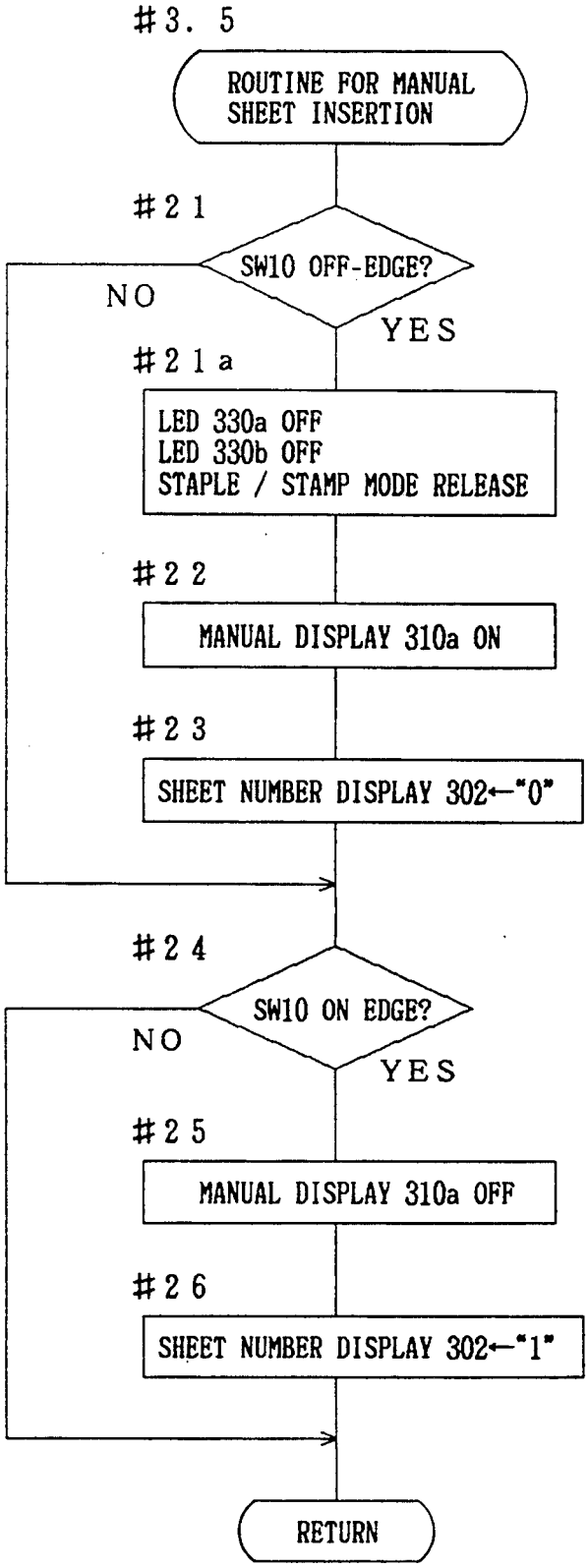
FIG. 9*c* is a flowchart showing a routine for exercising a manual sheet inserting mode.

Referring to FIG. 9*c*, the routine for operating by the manual tray 10 will be described:

Step #21 checks if SW10 has been just turned off (hereinafter referred to as "off edge"), that is, it checks if the opening of the manual tray has been detected. If the detection has not been checked, the sequence immediately advances to step #24. If step #21 detects that the tray has been just opened, step #21*a* turns off the staple display 330*a* and the stamp display 330*b*, and release the stapling mode and the stamping mode. Step #22 turns on the display 310*a*, and step #23 makes the number on display 302 to nought.

When step #24 detects that SW10 is on edge, that is, that the manual tray has been just closed, the display 310*a* is turned off at step #25, and the number on display 302 is made to "1" at step #26. Then, the sequence returns.

The selection routine for the finish mode shown in FIG. 9*a* sets a mode such as the stapling mode when the key 330 is pressed, if the mode is not in the manual mode. Step #3.5, which is the selection routine for the manual tray of FIG. 9*c*, allows the finishing mode to release when the tray is opened. However, the routine of FIG. 9*b* can be adopted for the selection routine for the finishing mode, and the routine of FIG. 9*d* can be adopted for the manual tray.

Figure 9D:
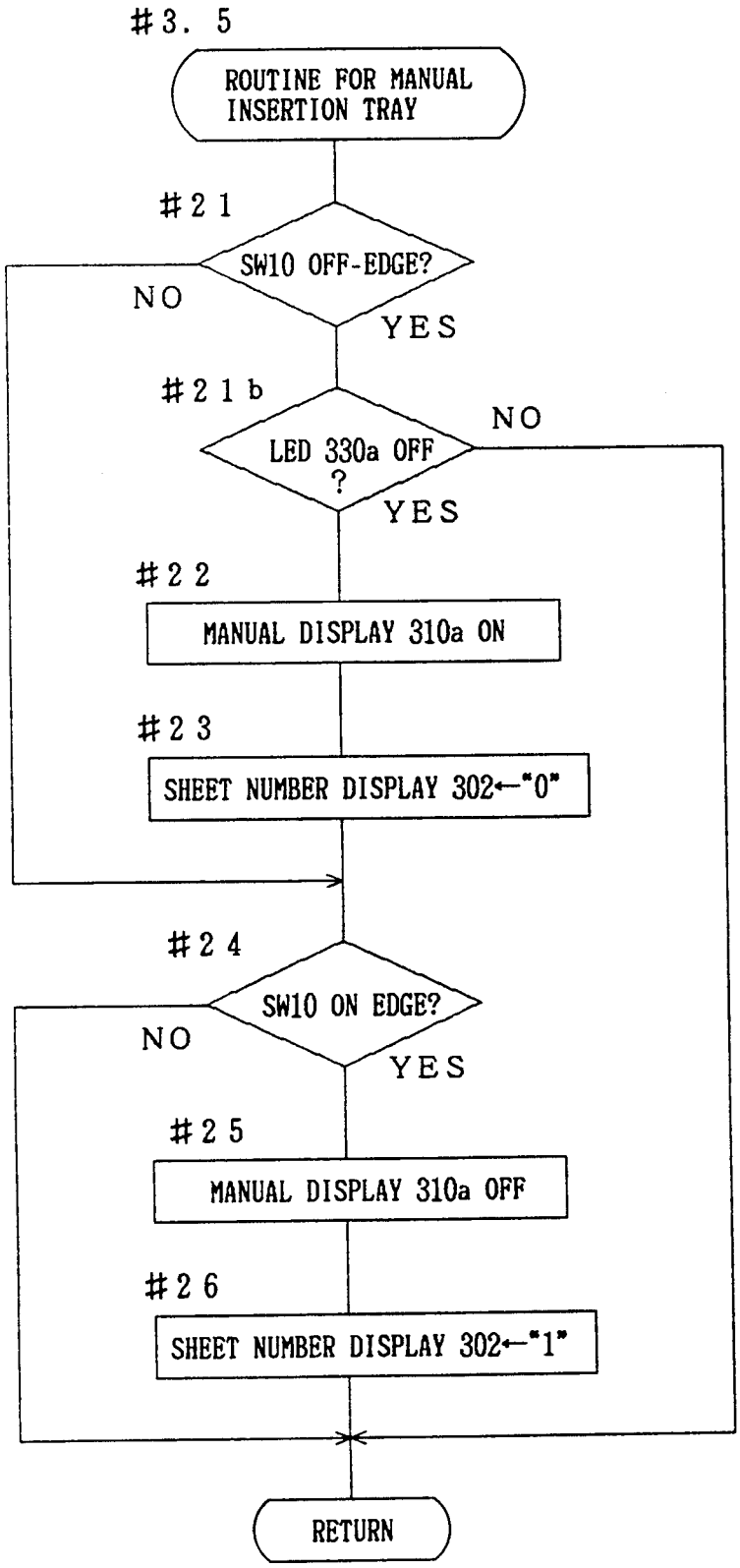
FIG. 9*d* is a flowchart showing a modified routine for exercising a manual sheet inserting mode.

At the routine of FIG. 9*b*, if the key 330 is on during the manual mode, the mode changes to the finishing mode, and simultaneously the manual mode is released (step #391, #392). In the routine of FIG. 9*d* the mode does not change to the manual mode during the finishing mode even if the tray is opened (step #21*b*).

Combinations of the routine for the finishing mode and the routine for the manual tray are summarized as follows:

| Routine for Finishing Mode ("R" means a routine) | | Routine for Manual Tray |
|---|---|---|
| R of FIG. 9a | + | R of FIG. 9c |
| R of FIG. 9a | + | R of FIG. 9d |
| R of FIG. 9b | + | R of FIG. 9c |
| R of FIG. 9b | + | R of FIG. 9d |

Figure 10:
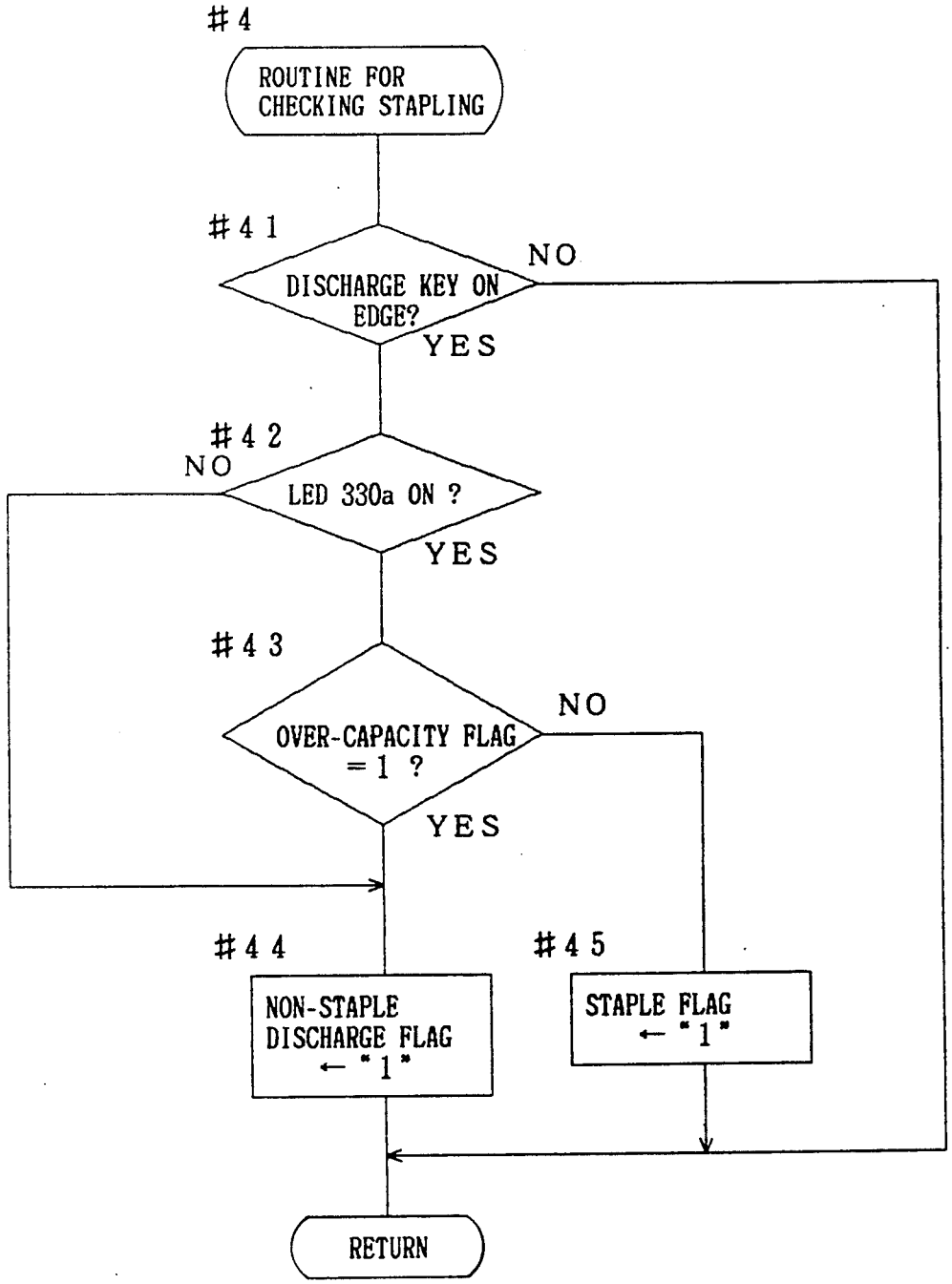
FIG. 10 is a flowchart showing a routine for checking a stapling operation.

Referring to FIG. 10, the routine for judging the stapling operation will be described:

Step #41 checks if the discharge key 340 is on edge, and if it is not on edge, the sequence immediately returns to the main routine. If it is on edge, step #42 judges whether the LED 330*a* is on or off. If it is on or the stapling mode is selected, the sequence advances to step #43. If it is off or the non-stapling mode is selected, the sequence advances to step #44.

Step #43 checks if an over-capacity flag described below is set to "1" in accordance with which the stapler 190 is started up. If it is "0" or the number of accommodated sheets does not exceed the capacity, step #45 sets a stapling flag to "1".

If at step #43 the over-capacity flag is "1" or if at step #42 the LED 330*a* is off, which respectively means that the number of accommodated sheets exceeds the capacity in the stapling mode or the non-stapling mode is selected, at step #44 the stapling is not performed but sets the non-stapling discharge flag to "1".

The stapling flag is forcibly set to "1" when the discharge key 340 is pressed as shown at step #41 on condition that the RDH is not used. If the RDH 30 is used, every time when a number of originals input by the ten-key 351 on the panel 350 of the RDH 30 are copied, and a corresponding number of copy sheets are placed on the stapling tray 150, the stapling flag is automatically set to "1".

Figure 11:
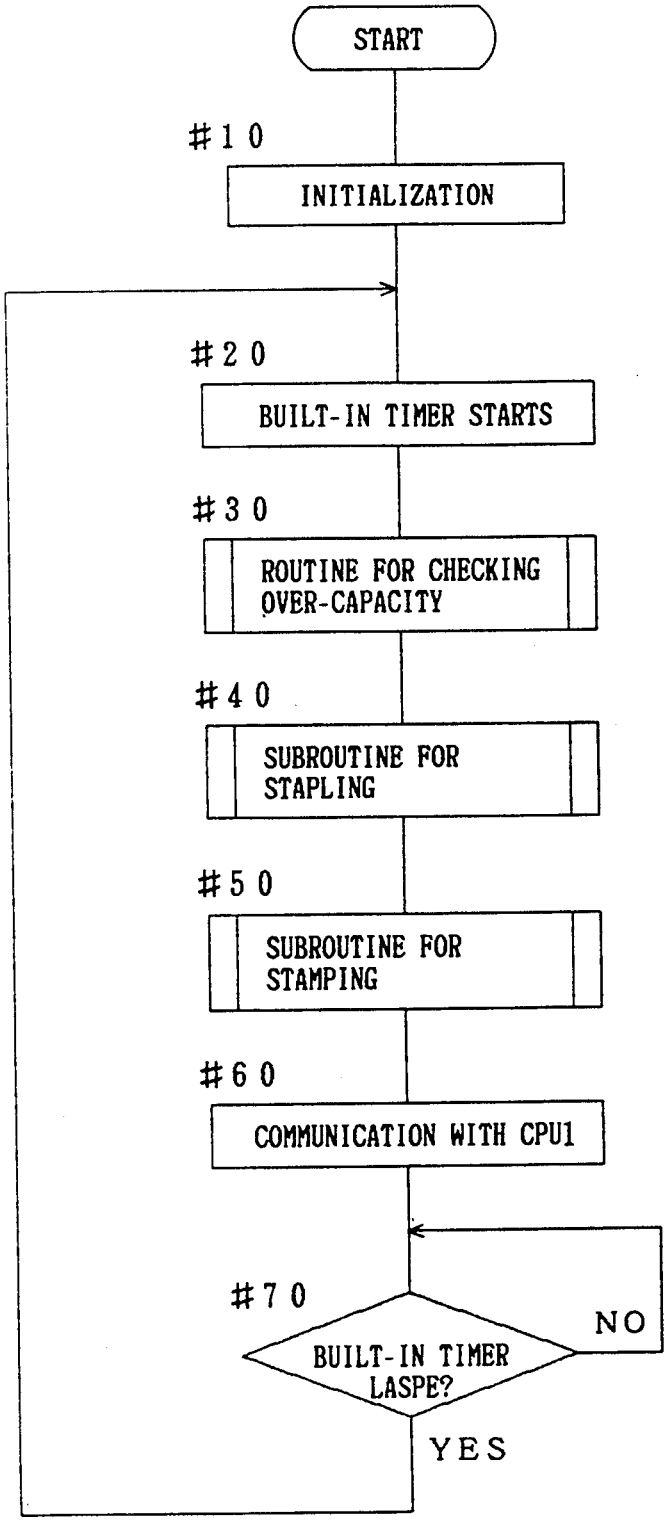
FIG. 11 is a flowchart showing a main routine executed by a micro-computer CPU2.

Referring to FIG. 11, the operation of the main routine under the control of the CPU2 will be described:

According to the routine, the CPU2 is reset, and the program starts. At step #10 the CPU2 is initialized by clearing the RAM and setting various registers, and the finisher unit 50 is initialized.

At step #20 a built-in timer in the CPU2 whose value is set at the initializing stage are started. At steps #30 to #60 the subroutines are consecutively called into action. After all the subroutines are finished, the sequence returns to step #20 upon completion of the operation of the timer at step #70.

In the main routine step #30 is a subroutine for checking an over-capacity of the stapling tray 150 for accommodating the copy sheets, step #40 is a subroutine at which the copy sheets on the tray are stapled by the stapler 190 into a booklet and discharge it, step #50 is a subroutine at which the copy sheets are stapled by the stapler 190 into a booklet and a mark is stamped on the top page of the booklet by the stamping unit 200A and the booklet is discharged. Step #60 is a subroutine for communication with the CPU1.

Figure 12:
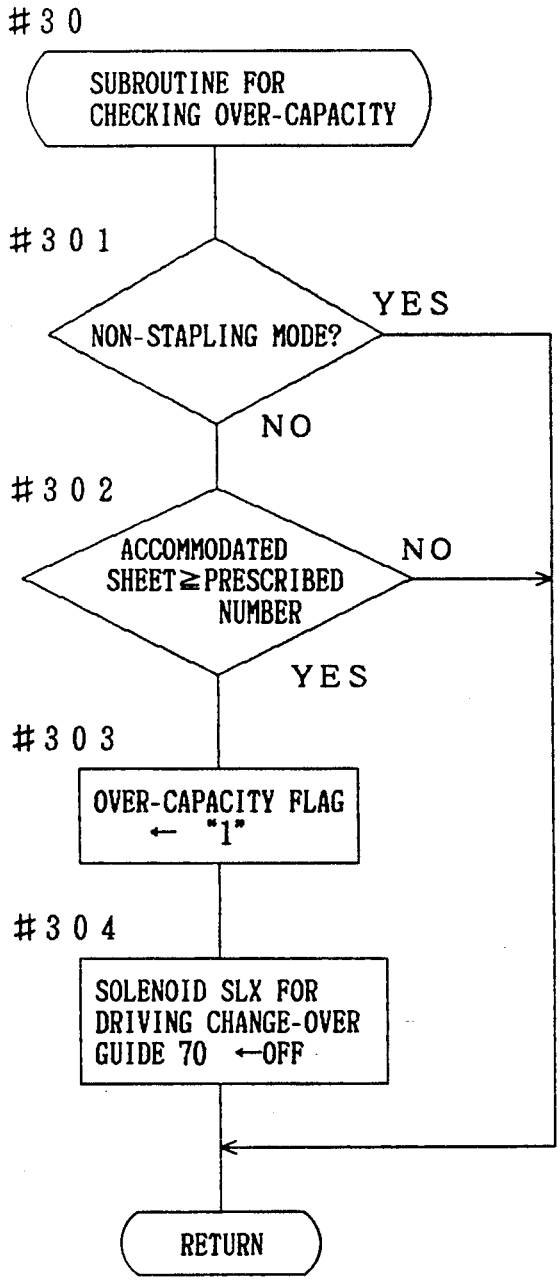
FIG. 12 is a flowchart showing a routine for checking a over-capacity.

Referring to FIG. 12, the over-capacity checking routine will be described:

Step #301 checks if the mode is the stapling mode, and if it is the non-stapling mode, the sequence returns to the main routine. If it is the stapling mode, step #302 checks if the number of sheets stacked in the stapling tray reaches a prescribed value. If the number does not reach it, the sequence returns to the main routine. If the number reaches it, step #303 sets the over-capacity flag to "1" and the sequence advances to step #304 which turns off the solenoid SLX, thereby leading the copy sheets continuously fed from the main body 1 to the discharging tray 80.

It may be arranged that step #302 checks if the total value of the numbers of sheets in the main body 1 and of the sheets in the stapling tray reaches the prescribed capacity of the tray.

Figure 13:
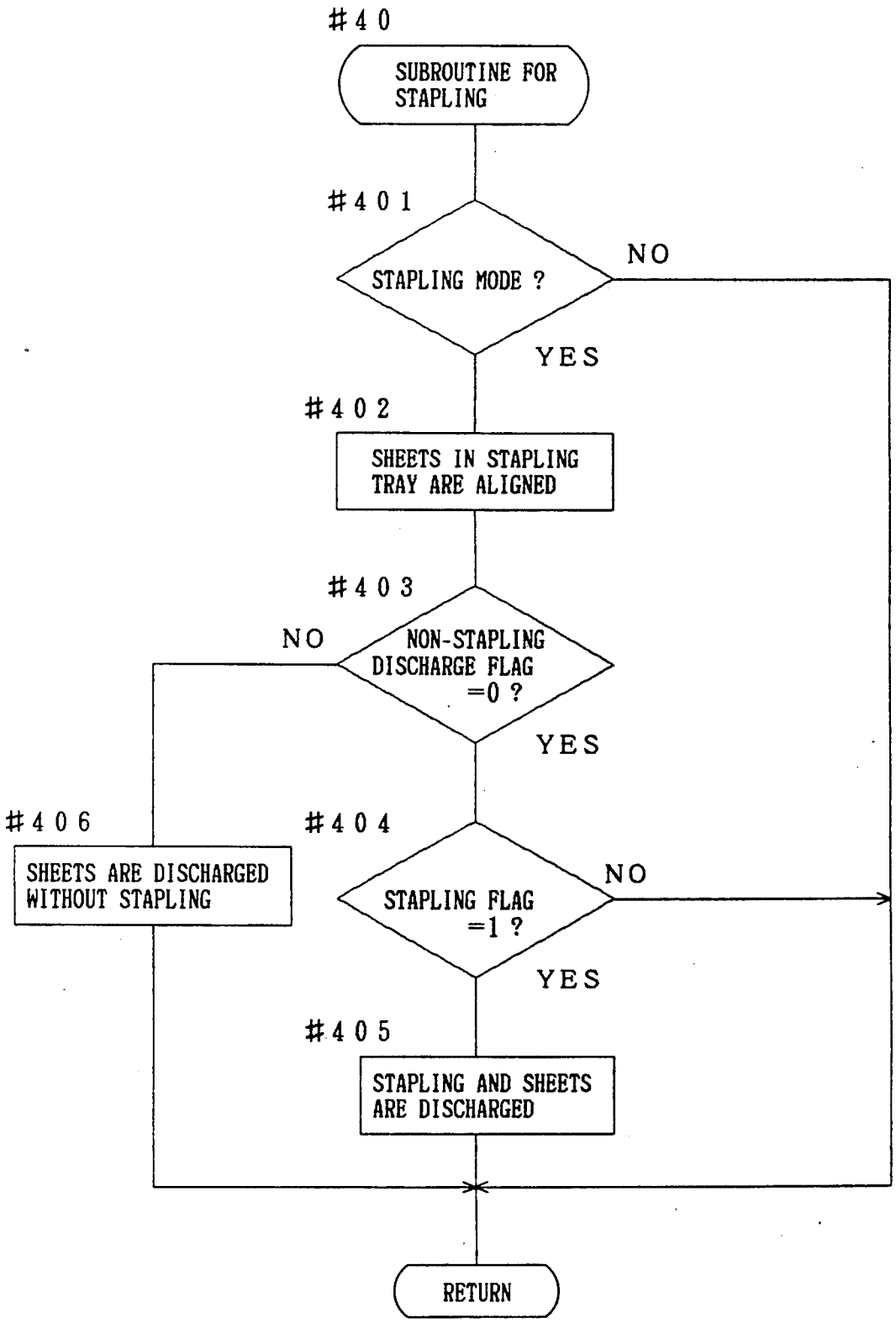
FIG. 13 is a flowchart showing a routine for performing the stapling operation.

Referring to FIG. 13, the stapling subroutine will be described:

Step #401 checks if the mode is the stapling mode. If it is not the stapling mode, the sequence returns to the main routine. If it is the stapling mode, the sequence advances to step #402 which aligns the copy sheets accommodated in the stapling tray 150.

Step #403 checks if the non-stapling discharge flag set in the main body 1 is reset to "0". If it is set to "1", which means that the key 340 on the operation panel of the main body 1 is pressed when the number of stacked copy sheets exceeds the prescribed capacity during the stapling mode or the stamping mode or that the discharging key 340 is pressed during the non-stapling mode, at step #406 the copy sheets in the stapling tray 150 are discharged without being stapled.

When step #403 finds that the non-stapling discharge flag is "0", step #404 checks if the stapling flag is "1". If the stapling flag is "0", the sequence returns because the sequence of copying operations must continue. If the stapling flag is "1", the copy sheets in the stapling tray 150 are discharged after they are stapled into a booklet.

Figure 14:
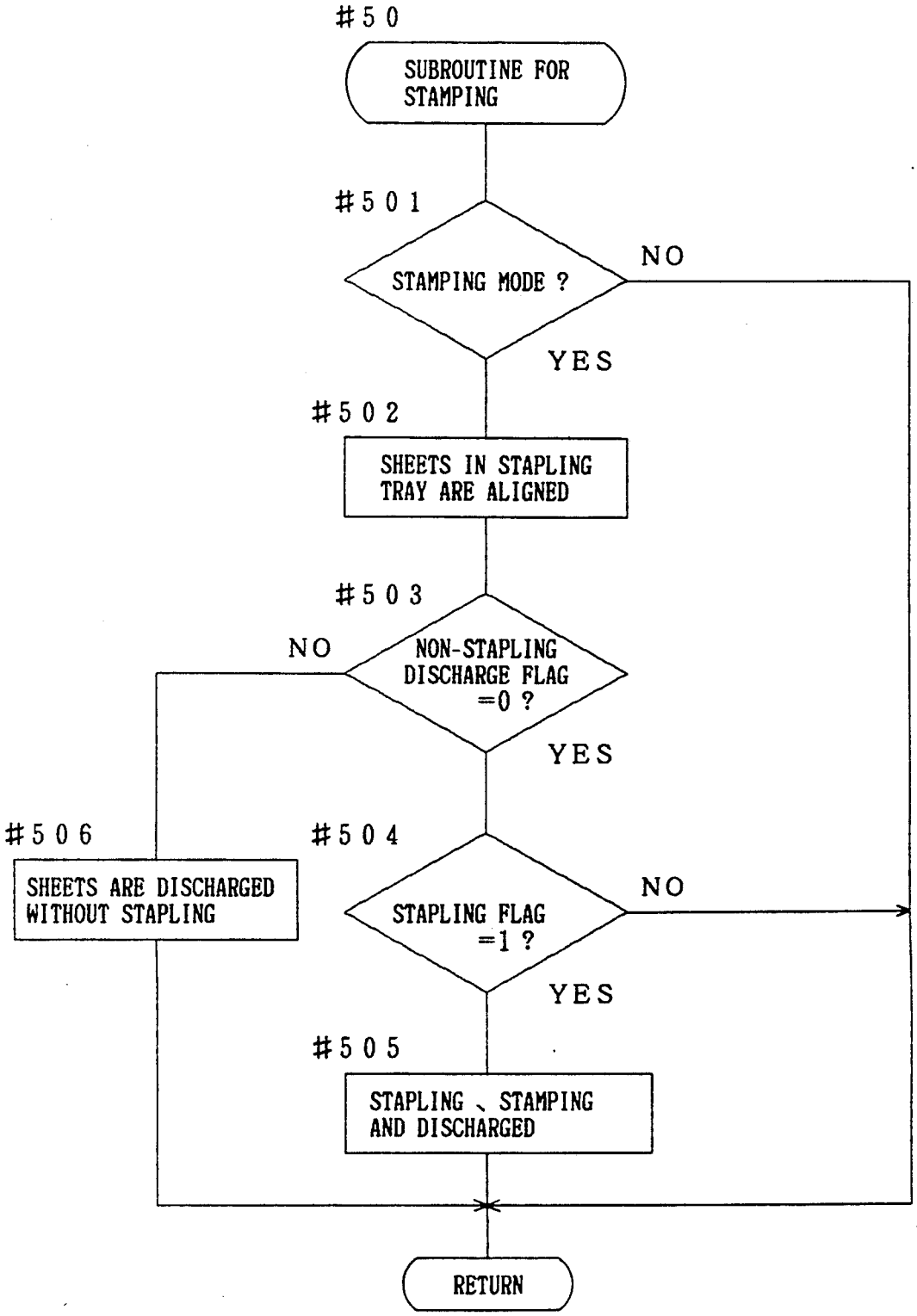
FIG. 14 is a flowchart showing a routine for performing the stamping operation.

Referring to FIG. 14, the stamping subroutine will be described:

Step #501 checks if the mode is a stamping mode. If it is not the stamping mode, the sequence returns to the main routine. If it is the stamping mode, the sequence advances to step #502 which aligns the copy sheets in the stapling tray 150.

Step #503 checks if the non-stapling discharge flag set in the main body 1 is reset to "0". If it is set to "1", which means that the key 340 on the operation panel of the main body 1 is pressed when the number of sheets accommodated exceeds the prescribed capacity in the stapling-and-stamping mode or that the discharging key 340 is pressed in the non-stapling mode, at step #506 the copy sheets in the stapling tray 150 are discharged without being stapled and stamped.

If step 503 finds that the non-stapling discharge flag is "0", step #504 checks if the stapling flag is set to "1". If the stapling flag is "0", the sequence returns to the main routine because the copying operation must continue. If the stapling flag is "1", the copy sheets in the stapling tray are discharged after they are stapled into a booklet and a desired mark is stamped on the top page thereof.

The detailed description has been given but it should be understood that various changes and modifications within the spirit and scope of the invention will become apparent to those skilled in the art from this detailed description.

For example, the key 330 for selecting the finishing mode and the displays 330*a* and 330*b* corresponding to the key 330 are mounted on the operation panel 300 of the main body 1, but the key 330 and the displays 330*a*, 330*b* can be disposed on the finisher unit. Practically, however, it is advantageous to mount them on the operation panel of the main body because the selection key 330 and displays 330*a* and 330*b* can be used when the finisher unit is equipped with the stapler alone or with the stamping unit alone.

What is claimed is:

1. An image forming apparatus which comprises:
means for forming images on copy sheets;
means for effecting a finishing process on the copy sheets;
means for feeding the copy sheets to the image forming means, the copy sheet feeding means including a manual copy sheet insertion section from which an operator can manually feed optional copy sheets to the image forming means; and
control means for prohibiting the use of both the manual copy sheet insertion section and the finishing means.

2. An image forming apparatus according to claim 1, wherein the finishing means comprises a stapler which staples a stack of copy sheets into booklets.

3. An image forming apparatus which comprises:
means for forming images on copy sheets;
means for effecting a finishing process on the copy sheets;
means for feeding the copy sheets to the image forming means, the copy sheet feeding means including an automatic copy sheet feeding section and a manual copy sheet insertion section from which an operator can manually feed optional copy sheets to the image forming means;
a first selection means for selecting the use of the manual copy sheet insertion section;
a second selection means for selecting the use of the finishing means; and
control means for prohibiting the selection of the use of the manual copy sheet insertion section by the first selection means when the finishing means is used.

4. An image forming apparatus according to claim 3, wherein the finishing means comprises a stapler which staples a stack of copy sheets into booklets.

5. An image forming apparatus which comprises:
means for forming images on copy sheets;
means for effecting a finishing process on the copy sheets;
means for feeding the copy sheets to the image forming means, the copy sheet feeding means including an automatic copy sheet feeding section and a manual copy sheet insertion section from which an operator can manually feed optional copy sheets to the image forming means;
first selection means for selecting the use of the manual copy sheet insertion section;
second selection means for selecting the use of the finishing means; and
control means for releasing the selection of the use of the finishing means when the manual copy sheet insertion section is selected by the first selection means under a condition that the use of the finishing means is selected, thereby selecting the use of the manual copy sheet insertion section.

6. An image forming apparatus according to claim 5, wherein the finishing means comprises a stapler which staples a stack of copy sheets into booklets.

7. An image forming apparatus which comprises:
means for forming images on copy sheets;
means for effecting a finishing process on the copy sheets;
means for feeding the copy sheets to the image forming means, the copy sheet feeding means including an automatic copy sheet feeding section and a manual copy sheet insertion section from which an operator can manually feed optional copy sheets to the image forming means;
first selection means for selecting the use of the manual copy sheet insertion section;
second selection means for selecting the use of the finishing means; and
control means for prohibiting the selection of the use of the finishing means by the second selection means under a condition that the manual copy sheet insertion section is selected.

8. An image forming apparatus according to claim 7, wherein the finishing means comprises a stapler which staples a stack of copy sheets into booklets.

9. An image forming apparatus which comprises:

means for forming images on copy sheets;

means for effecting a finishing process on the copy sheets;

means for feeding the copy sheets to the image forming means, the copy sheet feeding means including an automatic copy sheet feeding section and a manual copy sheet insertion section from which an operator can manually feed optional copy sheets to the image forming means;

first selection means for selecting the use of the manual copy sheet insertion section;

second selection means for selecting the use of the finishing means; and control means for releasing the selection of the use of the manual copy sheet insertion section when the use of the finishing means is selected by the second selection means under a condition that the manual copy sheet insertion section is selected, thereby selecting the use of the finishing means.

10. An image forming apparatus according to claim 9, wherein the finishing means comprises a stapler which staples a stack of copy sheets into booklets.

* * * * *